US005790153A

United States Patent [19]

Takagi

[11] Patent Number: 5,790,153

[45] Date of Patent: Aug. 4, 1998

[54] ELECTRODE ARRAY FOR AN IMAGE FORMING APPARATUS HAVING A MOUNTING MEMBER AWAY FROM THE CONTROL ELECTRODES

[75] Inventor: Osamu Takagi, Nagoya, Japan

[73] Assignee: Brother Kogyo Kabushiki Kaisha, Nagoya, Japan

[21] Appl. No.: 901,331

[22] Filed: Jul. 28, 1997

Related U.S. Application Data

[63] Continuation of Ser. No. 433,935, May 2, 1995, abandoned.

[30] Foreign Application Priority Data

Aug. 19, 1994 [JP] Japan ..... 6-195515

[51] Int. Cl.[6] ..... B41J 2/06

[52] U.S. Cl. ..... 347/55; 347/112

[58] Field of Search ..... 347/55, 112, 115, 347/141, 151, 140

[56] References Cited

U.S. PATENT DOCUMENTS 5,036,341 7/1991 Larsson ..... 347/55
5,293,181 3/1994 Iwao et al. ..... 347/55
5,414,500 5/1995 Furukawa ..... 347/55

FOREIGN PATENT DOCUMENTS 0 587 366 A1 3/1994 European Pat. Off. .
587366 3/1994 European Pat. Off. .
60-84547 5/1985 Japan .
5185641 8/1993 Japan .

*Primary Examiner*—Benjamin R. Fuller
*Assistant Examiner*—Charlene Dickens
*Attorney, Agent, or Firm*—Oliff & Berridge

[57] ABSTRACT

An aperture electrode member includes an insulating sheet having a plurality of apertures and a control electrode provided for each of the apertures. The control electrodes are switched independently of one another and cause toner powder transported thereto from a toner supply apparatus to selectively pass through the apertures so as to form an image on an image recording medium. A member for fixing the aperture electrode member to the toner supply apparatus is secured at locations of the insulating sheet other than the location of the wiring lines for the control electrodes.

22 Claims, 6 Drawing Sheets

ELECTRODE ARRAY FOR AN IMAGE FORMING APPARATUS HAVING A MOUNTING MEMBER AWAY FROM THE CONTROL ELECTRODES

This is a Continuation of application Ser. No. 08/433,935 filed May 2, 1995 now abandoned.

BACKGROUND OF THE INVENTION

1. Field of the Invention

The invention relates to an image forming apparatus for use with copying machines, printers, plotters, facsimile apparatus and like apparatuses.

2. Description of the Related Art

A conventional image forming apparatus is disclosed in EP 587,366 (Japanese Patent Laid-Open Applications Nos. Hei 6-155798 and Hei 6-79907) wherein driving signals are applied to an aperture electrode member, which has a plurality of small holes (hereinafter referred to as apertures) formed therein, in accordance with an image signal to control passage of toner particles through the apertures so that the toner particles passing through the apertures may form an image on an image recording medium (paper for printing or a like medium).

Referring to FIG. 4, the image forming apparatus 100 of the type just described includes an aperture electrode member 101, a carrying roller 114 opposed to an image recording medium 120 with the aperture electrode member 101 positioned therebetween, and a back electrode 122 located to the back of the image recording medium 120. The aperture electrode member 101 employed in the image forming apparatus 100 is formed from an insulating sheet 102 that is 25 μm thick and made of polyimide. The insulating sheet 102 has a plurality of apertures 106 of 100 μm in diameter, formed therein in a row along the longitudinal direction of the aperture electrode member 101, and has a control electrode 104 of copper foil of 0.1 μm thick and 20 μm wide formed around each of the apertures 106. Further, the aperture electrode member 101 is disposed such that the face thereof on which the control electrodes 104 are provided is opposed to the image recording medium 120.

In the image forming apparatus 100, when a control voltage is applied from a control voltage application circuit 108 to the control electrodes 104 in accordance with an image signal, electric fields are formed between the control electrodes 104 and the carrying roller 114 on which charged toner powder is carried so that toner powder flows are produced between the control electrodes 104 and the carrying roller 114. Then, the toner particles 116 on the carrying roller 114 pass through the apertures 106 and form an image on the image recording medium 120.

Referring to FIG. 5, the insulating sheet 102 of the aperture electrode member 101 is attached to a body of the image forming apparatus by means of a fixing member 107B. However, the insulating sheet 102 at a part carrying the wiring lines 104A for the control electrodes 104 is held, from the opposite faces thereof, between a fixing member 107A and the fixing member 107B by means of screws 103. Further, the aperture electrode member 101 is disposed in a lightly contacting condition with the carrying roller 114 under a resilient dragging force of a tension spring (not shown) which acts upon the fixing member 107B, and a voltage is applied between the control electrodes 104 and the carrying roller 114.

In the image forming apparatus described above, the fixing members 107A,107B are screwed such that they hold the wiring lines 104A of the control electrodes 104 therebetween. With the fixing method, when the aperture electrode member 101 is fixed to the image forming apparatus 100, a clamping force is applied to the wiring lines 104A of the control electrodes 104 or the insulating sheet 102 is likely bent across the fixing member 107A and stress concentrates there. Consequently, the wiring lines 104A of the control electrodes 104 are liable to be damaged or broken. If any of the wiring lines 104A of the control electrodes 104 is broken, it is impossible to control the voltage to the control electrode 104 to which the damaged or broken wiring line 104A was connected and, as a result, the flow of toner powder cannot be controlled in the aperture 106 located in such a control electrode 104. This causes errors, such as a picture element on the image recording medium 120 is partially missing or an unnecessary picture element is printed because of toner attracted by the back electrode which causes deterioration of the image.

SUMMARY OF THE INVENTION

It is an object of the invention to provide an image forming apparatus wherein wiring lines for control electrodes are not easily broken.

In order to attain the object described above, according to the invention, there is provided an image forming apparatus comprising an electrode array including an insulating sheet having a plurality of apertures formed therein and a control electrode provided at each of the apertures, toner supply means for supplying toner powder to the apertures of the electrode array, an image recording medium disposed remotely from the toner supply means with respect to the electrode array, control electrode driving means for controlling the control electrodes of the electrode array independently of one another to cause the toner powder to selectively fly from the toner supply means to the image recording medium passing through the apertures of the electrode array, wiring line means for interconnecting the control electrodes and the control electrode driving means, and fixing means located at locations of the electrode array at which the wiring line means are not provided for fixing the electrode array.

The fixing means may be provided at an end portion of the electrode array on the upstream side and another end portion of the electrode array on the downstream side in a direction in which the toner supply means supplies toner powder.

The fixing means may include two members, at least one of which is resiliently dragged by a resilient member.

In the image forming apparatus of the invention having the structure described above, the toner supply means supplies toner powder toward the apertures of the electrode array. Here, since a voltage is selectively applied by the control electrode driving means to those of the control electrodes which correspond to an image formation portion, the toner powder transported by the toner supply means selectively passes through the apertures of the electrode array and forms an image on the image recording medium. Although the wiring line means interconnect the control electrodes and the control electrode driving means, because the fixing means for the electrode array is provided at a location of the electrode array at which the wiring line means are not provided, breakage of the wiring line means does not occur frequently.

Further, in the image forming apparatus of the invention, the fixing means is provided at the end portion of the electrode array on the upstream side and the end portion of the electrode array on the downstream side in the direction in which the toner supply means supplies toner powder, and the electrode array is fixed to the image forming apparatus by the fixing means provided at the opposite end portions of the electrode array. Also in this instance, since the fixing means for the electrode array are provided at locations of the electrode array at which the wiring line means at the end portions upstream and downstream in the direction in which the toner supply means supplies toner powder, breakage of the wiring line means does not occur frequently.

In the image forming apparatus of the invention, the fixing means includes the two members, at least one of which is resiliently dragged by the resilient member, and consequently, the electrode array is fixed to the image forming apparatus. Also in this apparatus, because the fixing means for the electrode array is provided at a location of the electrode array at which the wiring line means are not provided, breakage of the wiring line means does not occur frequently.

As is apparent from the foregoing description, in the image forming apparatus of the invention, because the fixing means for the electrode array is provided at the location of the electrode array at which the wiring line means are not provided, any unnecessary stress which may be produced from various causes is not applied to the wiring line means and, consequently, breakage of the wiring line means is prevented. Accordingly, the invention can provide an image forming apparatus which can form an image of a high quality without causing an error with picture elements and is superior in durability.

Further, in the image forming apparatus of the invention, the fixing means is provided at the end portion of the electrode array on the upstream side and the end portion of the electrode array on the downstream side in the direction in which the toner supply means supplies toner powder, and the electrode array is fixed to the image forming apparatus by the fixing means provided at the opposite end portions of the electrode array. Also in this instance, since the fixing means for the electrode array are provided at locations of the electrode array at which the wiring line means at the end portions upstream and downstream in the direction in which the toner supply means supplies toner powder, an unnecessary stress which may be produced from various causes does not apply to the wiring line means, and consequently, breakage of the wiring line means does not occur frequently. Accordingly, the invention can provide an image forming apparatus which can form an image of a high quality without causing an error with picture elements and is superior in durability.

Furthermore, in the image forming apparatus of the invention, the fixing means includes the two members, at least one of which is resiliently dragged by the resilient member so that the electrode array is fixed to the image forming apparatus. Consequently, the image forming apparatus is superior in close contact between the electrode array and the toner supply means. Also, in this instance, because the fixing means for the electrode array is provided at a location of the electrode array at which the wiring line means are not provided, any unnecessary stress which may be produced from various causes is not applied to the wiring line means and, consequently, breakage of the wiring line means does not occur frequently. Accordingly, the invention can provide an image forming apparatus which can form an image of a high quality without causing an error with picture elements and is superior in durability.

BRIEF DESCRIPTION OF THE DRAWINGS

A preferred embodiment of the invention will be described in detail with reference to the following figures, wherein.

DETAILED DESCRIPTION OF THE PREFERRED EMBODIMENT

In the following, a preferred embodiment of the invention will be described with reference to the drawings.

First, an outline of an image forming apparatus 50 will be described with reference to FIG. 1.

Figure 1:
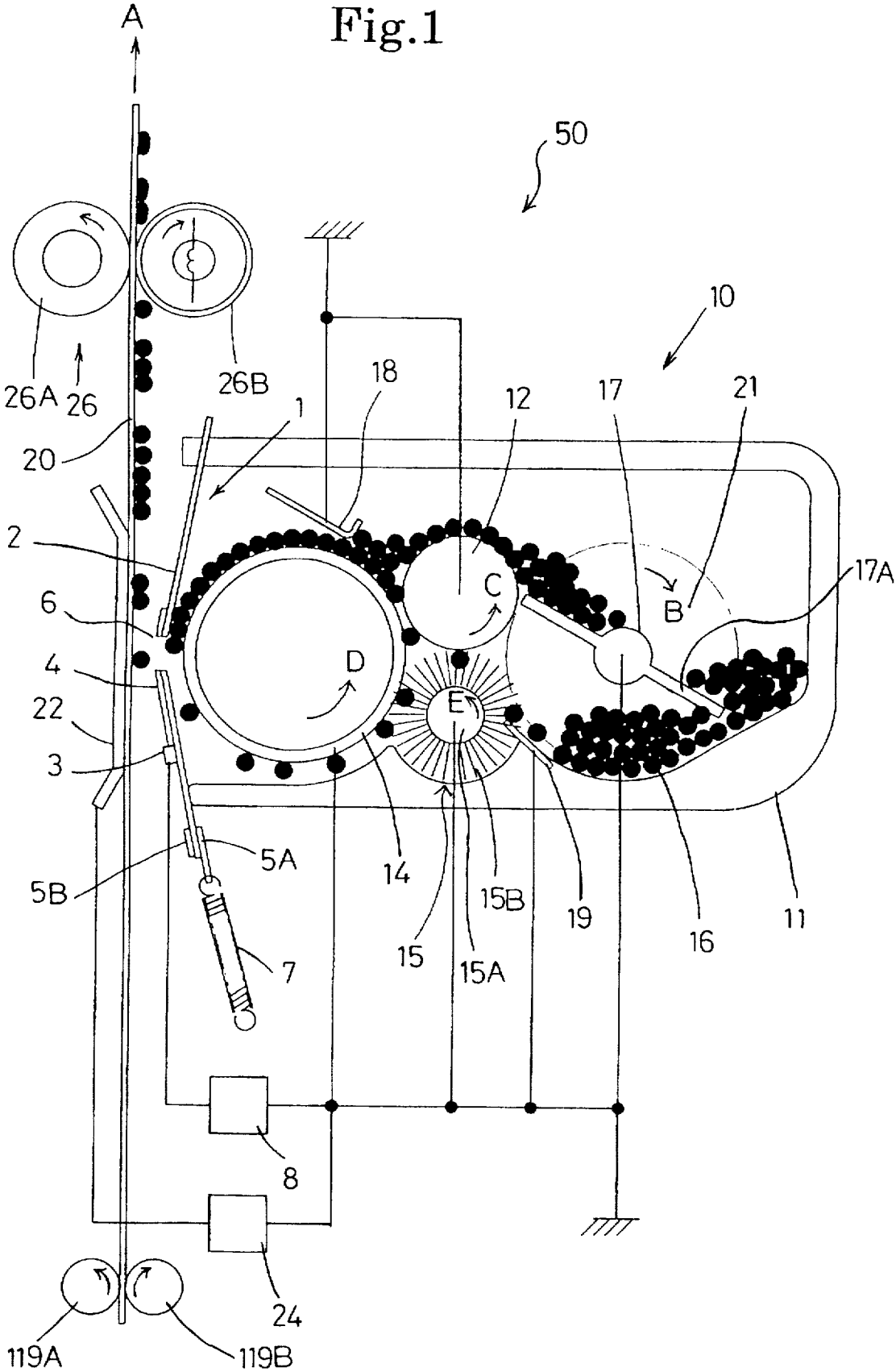
FIG. 1 is a front elevational view showing the structure of an image forming apparatus of a preferred embodiment of the invention.

FIG. 1 is a schematic view showing the structure of the image forming apparatus 50 of the invention. An aperture electrode member 1 for controlling toner powder flow is provided at a central location of the image forming apparatus 50. A back electrode plate 22 is disposed on a chassis (not shown) leftwardly (as shown in FIG. 1) of the aperture electrode member 1 with a gap of 1 mm from the aperture electrode member 1. A toner supply apparatus 10 is disposed rightwardly of the aperture electrode member 1. Further, an image recording medium 20, which is to be transported in the direction indicated by the arrow A and onto which an image is to be recorded, is inserted into and transported through the gap between the aperture electrode member 1 and the back electrode plate 22. Upstream, in the direction of transportation of the image recording medium 20, a pair of transport rollers 119A, 119B are supported on the chassis (not shown) for rotation and connected to a driving motor (also not shown). Downstream, in the direction of transportation of the image recording medium 20, a fixing apparatus 26 for fixing a toner image to the image recording medium 20 is provided on the chassis (not shown).

The toner supply apparatus 10 includes a toner case 11 which serves also as a housing of the entire toner supply apparatus 10. A toner tank 21 for accommodating toner powder 16 therein is provided at a right location within the toner case 11. An agitator 17, having two blades 17A for mixing and agitating non-used toner powder 16 and recovered toner powder 16, is supported on the toner case 11 and in the toner tank 21 and is connected to the driving motor (not shown).

A supply roller 12 for transporting toner powder 16, agitated by the agitator 17, to a carrying roller 14 is supported for rotation at a location leftwardly and upwardly of the agitator 17 on the toner case 11 and is connected to the driving motor (not shown). Further, at another location, leftwardly and downwardly of the agitator 17, a recovery roller 15 for recovering toner powder 16 into the toner tank 21 is supported for rotation on the toner case 11 and is drivingly connected to the driving motor (not shown). The recovery roller 15 is provided to exfoliate toner powder remaining on the carrying roller 14 and includes a shaft 15A made of stainless steel and a nylon brush 15B adhering to the shaft 15A. The nylon brush 15B is disposed such that an end portion thereof is held in contact with the surface of the carrying roller 14.

The carrying roller 14, of a cylindrical profile for carrying and transporting toner powder 16 to the aperture electrode member 1, is supported for rotation at a left location within the toner case 11 and connected to the driving motor (not shown). The carrying roller 14 and the supply roller 12 are disposed in parallel to each other and are in contact with each other by way of a toner powder layer carried on the carrying roller 14. Further, the carrying roller 14, the agitator 17, the recovery roller 15 and the supply roller 12 are supported for rotation on the toner case 11 such that the rotary shafts thereof extend in parallel to each other.

Further, as shown in FIG. 1, a toner layer controlling blade 18 for uniformly adjusting the amount of toner powder 16 carried on the surface of the carrying roller 14 and for charging the toner powder 16 uniformly is provided above the carrying roller 14 in the toner case 11. The toner layer controlling blade 18 is held in contact, at an end thereof, with the carrying roller 14.

A recovery blade 19, for introducing toner powder 16 recovered by the recovery roller 15 into the toner tank 21, is provided at a location where end portions of the blades 17A of the agitator 17 contact the end portions of the nylon brush 15B of the recovery roller 15. The recovery blade 19 is secured to the toner case 11 such that an end portion thereof is held in contact with the end portions of the nylon brush 15B of the recovery roller 15.

Figure 2:
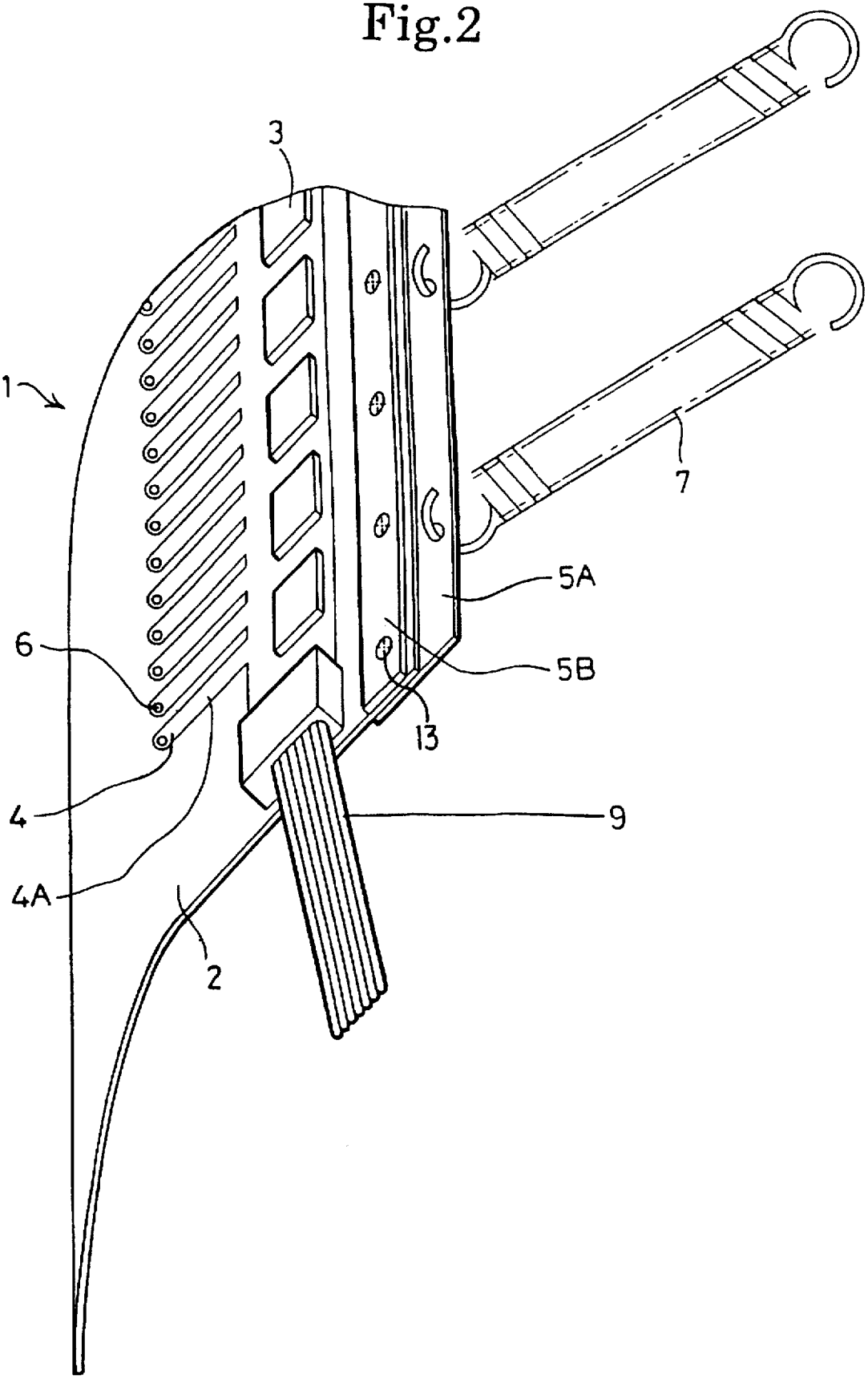
FIG. 2 is a perspective view showing the structure of an aperture electrode member employed in the image forming apparatus shown in FIG. 1.

The aperture electrode member 1, as shown in FIG. 2, has a plurality of apertures 6 of 100 μm in diameter formed in a row in an insulating sheet 2 that is 25 μm thick and made of polyimide. A control electrode 4, of copper foil 1 μm thick, is formed for each of the apertures 6 on an upper face of the insulating sheet 2. The control electrodes 4 are connected by way of wiring lines 4A to integrated circuits (ICs) 3 disposed at an end portion of the insulating sheet 2. The control electrodes 4 are switched by the ICs 3. The ICs 3 are connected to a control voltage application circuit 8, shown in FIG. 1, by way of a connection cable 9.

The structure peculiar to the invention will now be described. The wiring lines 4A of the control electrodes 4 are not provided at portions outside the portion of the aperture electrode member 1 at which the ICs 3 are provided, and the insulating sheet 2 is held at the portions where the wiring lines 4A are not provided. The insulating sheet 2 is secured between a pair of fixing members 5A and 5B by means of screws 13. Further, the fixing member 5A is normally resiliently dragged and biased toward a frame (not shown) by a plurality of tension springs 7. The other end portion of the insulating sheet 2, remote from the end portion which is dragged by the tension springs 7, is secured to the toner case 11, as shown in FIG. 1. Accordingly, the aperture electrode member 1 is fixed with the apertures 6 held in contact with the carrying roller 14 such that the control electrodes 4 are opposed to the image recording medium 20. Because the wiring lines 4A of the control electrodes 4 are not held between the fixing members 5A and 5B, they are not acted upon by any unnecessary stress and, consequently, the possibility that they may be broken by such unnecessary stress is reduced.

Figure 3:
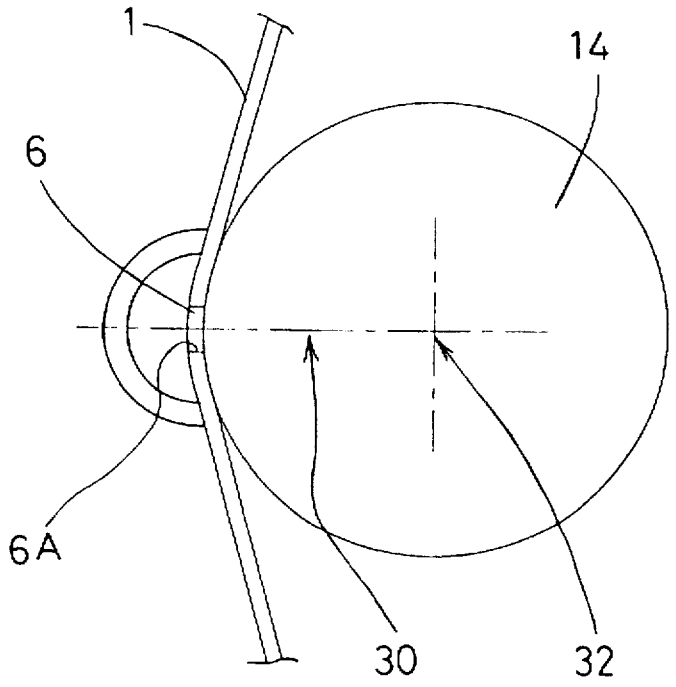
FIG. 3 is a schematic view showing the positional relationship between the aperture electrode member and a carrying roller employed in the image forming apparatus shown in FIG. 1.
Figure 4:
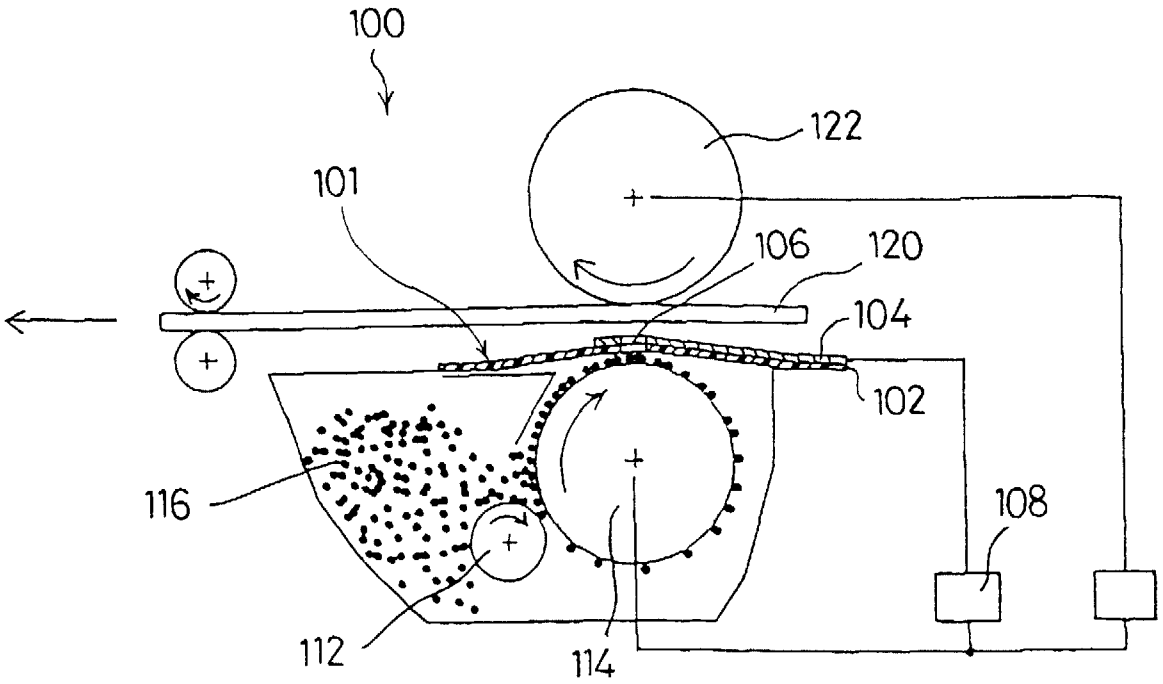
Fig.4 RELATED ART
FIG. 4 is a front elevational view showing an example of the structure of a conventional image forming apparatus.
Figure 5:
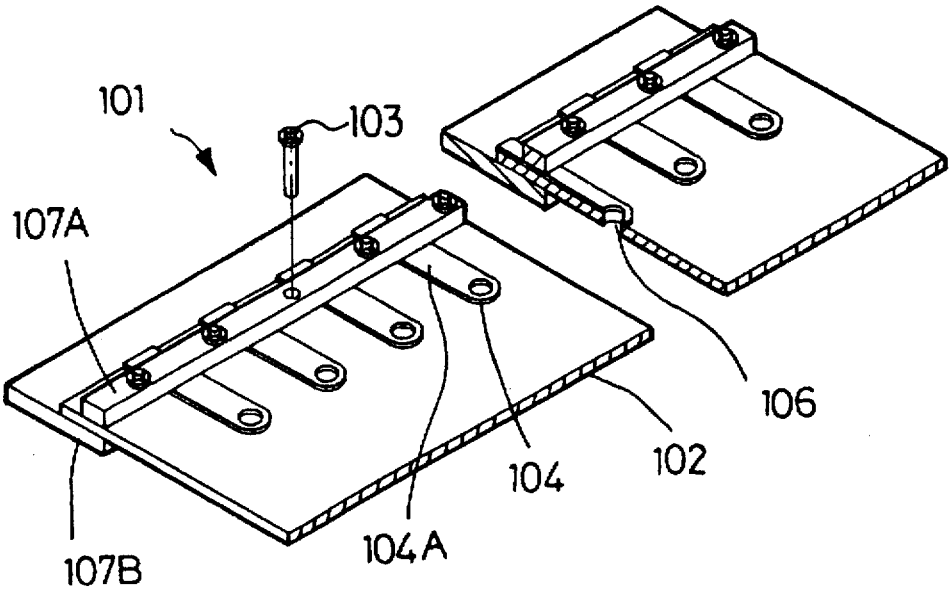
Fig.5 RELATED ART
FIG. 5 is a perspective view showing an example of an aperture electrode member employed in a conventional image forming apparatus.

As shown in FIG. 3, each of the apertures 6 is disposed such that the center line 30 thereof passes along a radius through the circumferential face and the center axis 32 of the carrying roller 14. Accordingly, the apertures 6 are disposed uniformly in the vertical direction with reference to the radius of the carrying roller 14 and, consequently, the distribution of toner powder 16 which passes the apertures 6 is uniform over the entire area of the apertures. Further, since the wall face 6A of each of the apertures 6 and the flying direction of toner powder 16 from the aperture are parallel to each other, the toner powder 16 can flow in a stable manner.

The aperture electrode member 1 is held in contact with the carrying roller 14 such that it is deformed at an equal angle above and below the apertures 6 as seen in FIG. 3. Consequently, the contacting area between the aperture electrode member 1 and the carrying roller 14 can be increased. Because the apertures 6 and the carrying roller 14 can be contacted uniformly with each other, the occurrence of an irregularity in density of toner powder can be suppressed to the utmost.

As shown in FIG. 1, the control voltage application circuit 8 is connected between the control electrodes 4 and the carrying roller 14 by way of the ICs 3 for switching. The control voltage application circuit 8 is constructed so as to apply a voltage of +50 V to the control electrodes 4 in response to an image signal sent thereto from image signal reception means (not shown). It is to be noted that the image signal reception means is connected to a computer, an image reading apparatus, an image communication apparatus or a like apparatus.

Further, a DC power source 24 is connected between the back electrode plate 22 and the carrying roller 14, as shown in FIG. 1. The DC power source 24 can apply a voltage of +1 kV to the back electrode plate 22.

In operation, the agitator 17 is rotated in the direction indicated by the arrow B (FIG. 1) by rotation of the driving motor (not shown) whereupon toner powder 16 in the toner tank 21 is agitated and transported to the supply roller 12 so that it sticks to the supply roller 12. By rotation of the driving motor, the supply roller 12 is rotated in the direction indicated by the arrow C so that the toner powder 16, sticking to the supply roller 12, is rubbed against and transferred to the carrying roller 14. The toner powder 16 carried on the carrying roller 14 is leveled into a thin layer and negatively charged by the toner layer controlling blade 18 and is then transported toward the aperture electrode member 1 as the carrying roller 14 rotates in the direction indicated by the arrow D, by rotation of the driving motor. Then, the toner powder 16 on the carrying roller 14 is supplied to locations below the apertures 6 while it is rubbed by the insulating sheet 2 of the aperture electrode member 1.

Here, in response to an image signal sent from the image signal reception means (not shown) to the control voltage application circuit 8, a voltage of +50 V is applied from the control voltage application circuit 8 by way of the ICs 3 on the insulating sheet 2 to those of the control electrodes 4 which correspond to the image signal. As a result, around the apertures 6 which correspond to the image signal, electric lines of force are formed from the control electrodes 4 to the carrying roller 14 due to a potential difference between the control electrodes 4 and the carrying roller 14. Consequently, the negatively charged toner powder 16 is acted upon by an electrostatic force toward a higher potential side and is thus attracted from the carrying roller 14 toward the control electrodes 4 passing through the apertures 6. The thus drawn out toner powder 16 is moved toward the image recording medium 20 by an electric field formed between the image recording medium 20 and the aperture electrode member 1 by the voltage of +1 kV applied to the back electrode plate 22 and is deposited on the image recording medium 20 to form picture elements.

Meanwhile, those of the control electrodes 4 which do not correspond to the image signal are kept at 0 V by the control voltage application circuit 8. As a result, no electric field is formed between the carrying roller 14 and the control electrodes 4, and the toner powder 16 on the carrying roller 14 is not acted upon by an electrostatic force and consequently does not pass through the corresponding apertures 6.

Here, after a row of picture elements are formed on the surface of the image recording medium 20 with the toner powder 16, the image recording medium 20 is transported by a distance corresponding to one picture element in the direction of the arrow A by the transport rollers 119A, 119B. Then, as the process of image formation described above is repeated, a toner powder image is formed on the entire surface of the image recording medium 20. Thereafter, the thus-formed toner powder image is transported to the fixing apparatus 26 by the transport rollers 119A,119B and a transport roller (not shown) and then fixed to the image recording medium 20 by the fixing apparatus 26. The fixing apparatus 26 is of the type wherein a heater is built into a fixing roller 26B to effect heating fixation. However, the fixing apparatus 26 may alternatively be of the pressurization fixation type wherein fixation is performed by a pressure applied between the fixing roller 26B and a follower roller 26A.

On the other hand, the toner powder 16 which does not pass through the apertures 6 but remains on the carrying roller 14 is transported toward the recovery roller 15 by rotation of the carrying roller 14 in the direction of the arrow D. Then, when the toner powder 16 contacts the nylon brush 15B of the recovery roller 15, it is exfoliated by and sticks to the nylon brush 15B as the recovery roller 15 is rotated in the direction indicated by the arrow E. Thereafter, the toner powder 16 sticking to the nylon brush 15B is exfoliated by the recovery blade 19 and recovered into the toner tank 21. The toner powder 16 recovered in the toner tank 21 is mixed and agitated with non-used toner powder 16 by rotation of the agitator 17 and, then, part of the toner powder 16 again sticks to the supply roller 12 and is transported to the carrying roller 14.

Accordingly, the toner powder 16 is continuously circulated in the apparatus. Consequently, the toner powder 16 is not deteriorated by frictional heat at all. Further, the toner powder 16 charged on the carrying roller 14 is likely discharged naturally as it is recovered into the toner tank 21 and, when it is used the next time, it has an optimum charging characteristic and accordingly can be controlled readily.

In the image forming apparatus 50 of the present embodiment, although the fixing members 5A,5B are screwed together, because the fixing members 5A,5B are not provided at the locations of the wiring lines 4A for the control electrodes 4 of the aperture electrode member 1, they do not apply any unnecessary forces to the wiring lines 4A of the control electrodes 4 that may cause a problem such as the breakage of the wiring lines 4A. Further, since the fixing members 5A,5B do not hold the wiring lines 4A of the control electrodes 4 therebetween, sufficient force can be applied to the fixing members in order to screw them tightly to secure the aperture electrode member 1 with certainty.

Further, even if the aperture electrode member 1 is acted upon toward the image recording medium 20 by an inadvertent force by rotation of the carrying roller 14 during the image forming operation, because the fixing members 5A,5B are not provided at the locations of the aperture electrode member 1 for the wiring lines 4A for the control electrodes 4, the wiring lines 4A will not be broken by deformation such as the bending of the aperture electrode member 1.

It is to be noted that the invention is not limited to the embodiment described in detail above and many changes and modifications can be made thereto without departing from the spirit and scope of the invention as set forth herein.

For example, while, in the image forming apparatus 50 of the embodiment, a plurality of tension springs 7 are anchored to the fixing member 5A to resiliently draw the fixing member 5A toward the frame, the dragging means is not limited to a tension spring but may be any member which has suitable elasticity. For example, a rubber member or a resin member may be used for the dragging means.

Further, although, in the embodiment, the aperture electrode member 1 is drawn only at an end portion thereof by the tension springs, the invention may be applied also to another apparatus wherein the aperture electrode member 1 is dragged at the opposite end portions thereof by tension springs.

Further, although in the embodiment the fixing members 5A,5B are formed from two plates screwed to the insulating sheet 2 from the opposite faces of the insulating sheet 2 by screws 13, they may be secured to the insulating sheet 2 by other suitable means, for example, adhesion by means of a bonding agent, or only one fixing member may be provided.

Figure 6:
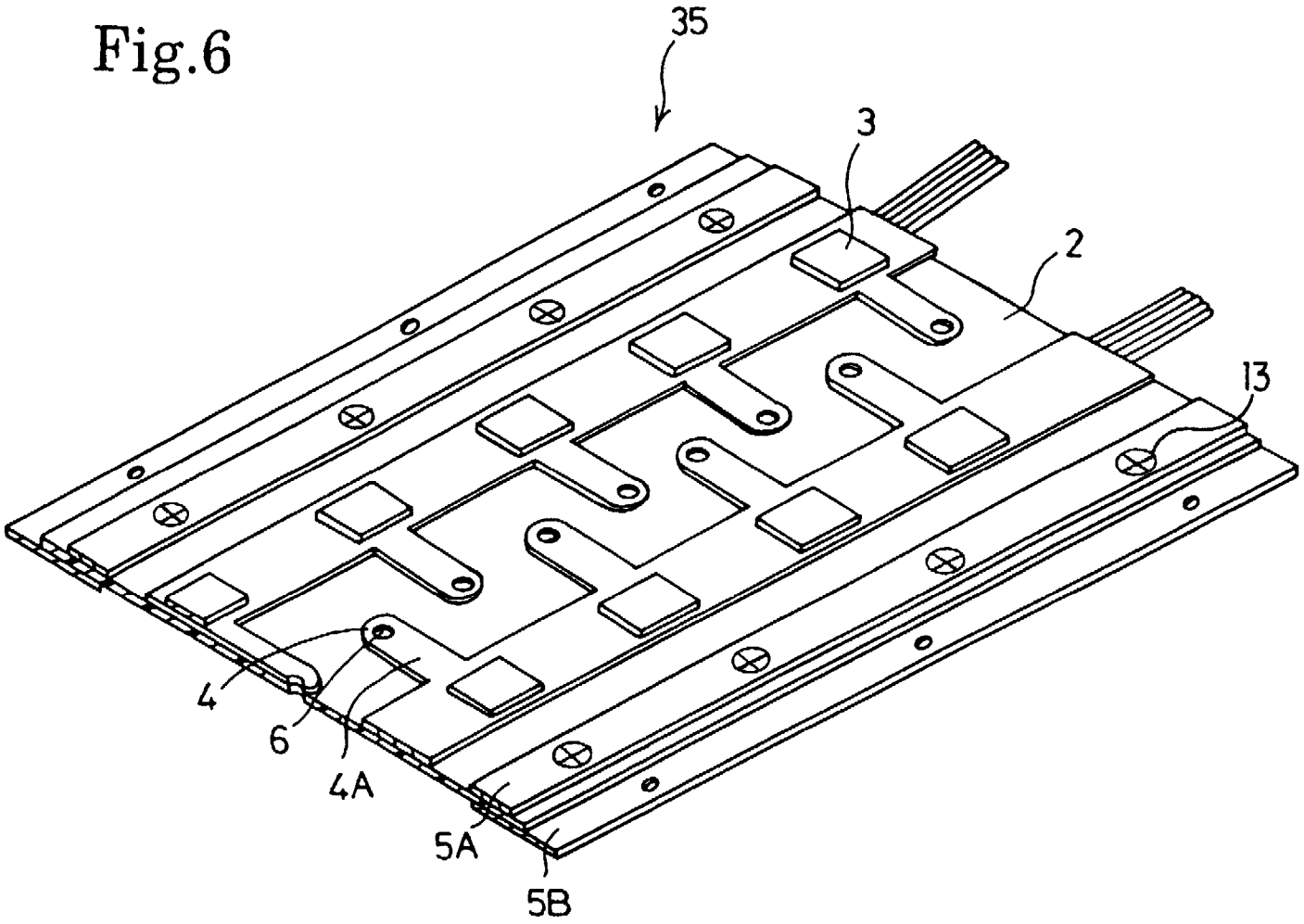
FIG. 6 is a perspective view showing the structure of a modified aperture electrode member which may be employed in the image forming apparatus shown in FIG. 1.

Further, the wiring lines 4A for the control electrodes 4 may otherwise extend on the opposite sides of the row of apertures, as shown in FIG. 6, or may extend on the opposite side of the row of apertures to that in the embodiment described above. In the latter case, the wiring lines 4A of the control electrodes 4 must be formed such that they bypass the locations of the insulating sheet 2 at which the insulating sheet 2 is secured to the toner case 11.

On the other hand, while the ICs 3 in the embodiment described above are arranged in a row along an end portion of the aperture electrode member 1, even where the ICs 3 are arranged along the opposite end portions of an aperture electrode member 35, as shown in FIG. 6, breaking of the wiring lines can be prevented by providing the fixing members 5A,5B at locations of the aperture electrode member 1 at which no wiring lines are arranged.

Further, it is not necessary to mount the ICs 3 on the aperture electrode member 1. The ICs 3 may be mounted on a control circuit board (not shown) which is directly connected to the wiring lines 4A of the control electrodes 4. Further, the connecting method between them is not limited to wire bonding.

In the embodiment described above the control voltage to the apertures which do not correspond to an image is described to be 0 V. The voltage may be a negative voltage of −30 V to −50 V. In this instance, a more clean-cut image can be obtained.

Further, in the embodiment described above, the aperture electrode member 1 is employed as a toner powder flow control means, however an electrode member in the form of a net as disclosed, for example, in U.S. Pat. No. 5,036,341 may be employed instead.

Lastly, in the described embodiment, the recovery roller 15, in the form of a brush, is employed as means for recovering the toner powder remaining on the carrying roller 14. The means is not limited to the recovery roller 15, but it may be made of silicon rubber having high stickiness or the toner powder remaining on the carrying roller may be exfoliated by means of a resin blade of urethane or a like material. In this instance, the exfoliated toner powder must be recovered into the toner tank 21 by a member such as the recovery roller 15 employed in the embodiment described above which is located below the resin blade.

What is claimed is:

1. An image forming apparatus for forming images on an image recording medium, comprising:

an electrode array including an insulating sheet that has an end connecting portion, a plurality of apertures formed in the insulating sheet and a control electrode provided at each of said apertures;

toner supply means for supplying toner powder to said apertures of said electrode array;

a feed path for the image recording medium disposed remotely from said toner supply means with respect to said electrode array;

control electrode driving means for controlling each said control electrode of said electrode array independently of one another to cause the toner powder to selectively fly from said toner supply means to said image recording medium by passing through said apertures of said electrode array, said control electrode driving means provided adjacent to the end connecting portion;

wiring line means for interconnecting said control electrodes and said control electrode driving means; and fixing means, attached to said insulating sheet only at the end connecting portion of said insulating sheet at which said wiring line means and said control electrode driving means are not provided, for positioning said electrode array relative to said toner supply means.

2. The image forming apparatus according to claim 1, wherein said fixing means is provided at an end portion of said electrode array upstream and another end portion of said electrode array downstream in a direction in which said toner supply means supplies toner powder.

3. The image forming apparatus according to claim 1, wherein said fixing means includes at least one member, said fixing means being resiliently pulled by a resilient member.

4. The image forming apparatus according to claim 3, wherein said resilient member is a tension spring.

5. The image forming apparatus according to claim 3, wherein said resilient member is made of rubber.

6. The image forming apparatus according to claim 1, wherein said fixing means includes two members for holding said insulating sheet of said electrode array therebetween, said two members being interconnected by connecting means.

7. The image forming apparatus according to claim 6, wherein one of said two members of said fixing means is connected to said insulating sheet by said connecting means.

8. The image forming apparatus according to claim 6, wherein said connecting means includes a screw.

9. The image forming apparatus according to claim 6, wherein said connecting means is a bonding agent.

10. The image forming apparatus according to claim 1, wherein said toner supply means includes a toner case which serves also as a housing for said toner supply means, and said electrode array is secured at an end thereof to said toner case.

11. The image forming apparatus according to claim 1, wherein said toner supply means includes agitation means for agitating toner powder, supply means for supplying the toner powder agitated by said agitation means to toner carrying means provided for supplying the toner powder to said apertures of said electrode array, and recovery means for recovering toner powder remaining on said toner carrying means.

12. The image forming apparatus according to claim 11, wherein said electrode array is held in contact with said toner carrying means in such a manner as to be deformed at an equal angle upstream and downstream in a direction in which said toner supply means supplies toner powder with respect to said apertures of said electrode array.

13. The image forming apparatus according to claim 1, wherein said control electrode driving means applies 0 V or a negative control voltage to each said control electrodes of said electrode array which do not correspond to an image.

14. An aperture electrode member for a printing device having a body enclosing operating components to include a toner case with a rotatable toner carrying roller mounted therein, the aperture electrode member comprising:

an insulating sheet having opposing ends on a longitudinal axis, opposing sides on a width axis and a plurality of apertures therethrough, said apertures aligned along the longitudinal axis;

a control electrode surrounding each aperture of said plurality of apertures;

a wiring line extending from each control electrode;

a control member provided adjacent at least one side of said opposing sides parallel to said longitudinal axis, each said wiring line connected to said control member;

an attachment portion comprising a strip of said insulating sheet at both sides of said opposing sides devoid of said control member and said wiring lines; and fixing means for attaching the aperture electrode member to the printing device, said fixing means attached only to said attachment portion of said insulating sheet.

15. The aperture electrode member according to claim 14, wherein said attachment portion extends to a side of said control member away from said plurality of apertures.

16. The aperture electrode member according to claim 14, wherein said fixing means comprises a first fixing member affixed to one surface of said attachment portion and a second, larger fixing member affixed to an opposite surface of said attachment portion.

17. The aperture electrode member according to claim 16, wherein screws are used to affix said first fixing member and said second fixing member to said attachment portion and to one another.

18. The aperture electrode member according to claim 16, wherein said first fixing member and said second fixing member are affixed to said attachment portion by an adhesive.

19. The aperture electrode member according to claim 14, further comprising resilient attachment means for attaching said fixing means to the printing device.

20. The aperture electrode means according to claim 19, wherein said resilient attachment means is one of a plurality of springs and a plurality of elastic elements.

21. The aperture electrode means according to claim 16, further comprising resilient attachment means for attaching one of said first fixing member and said second fixing member to the printing device.

22. The aperture electrode means according to claim 21, wherein said resilient attachment means is one of a plurality of springs and a plurality of elastic elements.

* * * * *